US008653371B2

(12) United States Patent
Kibe et al.

(10) Patent No.: US 8,653,371 B2
(45) Date of Patent: Feb. 18, 2014

(54) RADIATION RESISTANT ELECTRIC WIRE AND RADIATION RESISTANT CABLE

(75) Inventors: Tamotsu Kibe, Hitachi (JP); Yoshiaki Nakamura, Hitachi (JP); Ryutaro Kikuchi, Mito (JP)

(73) Assignee: Hitachi Cable, Ltd., Tokyo (JP)

( * ) Notice: Subject to any disclaimer, the term of this patent is extended or adjusted under 35 U.S.C. 154(b) by 352 days.

(21) Appl. No.: 13/029,224

(22) Filed: Feb. 17, 2011

(65) Prior Publication Data

US 2011/0209898 A1 Sep. 1, 2011

(30) Foreign Application Priority Data

Feb. 17, 2010 (JP) ..... 2010-032839

(51) Int. Cl.
*H01B 7/00* (2006.01)

(52) U.S. Cl.
USPC ..... 174/110 R; 174/110 PM; 174/120 R

(58) Field of Classification Search
USPC ..... 174/110 R, 110 PM, 120 R, 121 R
See application file for complete search history.

(56) References Cited

U.S. PATENT DOCUMENTS

| | | | | |
|---|---|---|---|---|
| 6,242,097 | B1 * | 6/2001 | Nishiguchi et al. | 428/383 |
| 6,296,935 | B1 * | 10/2001 | Higashiura et al. | 428/373 |
| 6,608,256 | B2 * | 8/2003 | Suzuki et al. | 174/117 F |
| 7,196,123 | B2 * | 3/2007 | Watanabe | 523/456 |
| 7,485,810 | B2 * | 2/2009 | Bates et al. | 174/110 R |
| 7,518,064 | B2 * | 4/2009 | Morioka et al. | 174/120 R |
| 2007/0185284 | A1 * | 8/2007 | Ok et al. | 525/425 |
| 2008/0081873 | A1 * | 4/2008 | Kanae et al. | 525/63 |
| 2008/0187759 | A1 * | 8/2008 | Fukuda et al. | 428/411.1 |
| 2010/0101827 | A1 * | 4/2010 | Fujimoto et al. | 174/120 C |

FOREIGN PATENT DOCUMENTS

| | | |
|---|---|---|
| JP | 05-125251 A | 5/1993 |
| JP | 10-120792 A | 5/1998 |

* cited by examiner

*Primary Examiner* — William H Mayo, III
(74) *Attorney, Agent, or Firm* — Foley & Lardner LLP

(57) ABSTRACT

A radiation resistant electric wire includes: a conductor; an inner insulating layer comprising a naphthylene group-containing polymer; and an outer insulating layer comprising a cross-linked polyolefin. The conductor is coated with the inner insulating layer and the outer insulating layer therearound.

16 Claims, 1 Drawing Sheet

RADIATION RESISTANT ELECTRIC WIRE AND RADIATION RESISTANT CABLE

The present application is based on Japanese patent application No. 2010-032839 filed on Feb. 17, 2010, the entire contents of which are incorporated herein by reference.

BACKGROUND OF THE INVENTION

1. Field of the Invention

This invention relates to a radiation resistant electric wire and a radiation resistant electric cable, which is formed by use of a fire retardant resin composition having excellent radiation resistance.

2. Description of the Related Art

Electric wires or cables for use in nuclear power stations, radioactive waste disposal facilities, breeder reactors or the like are exposed to radiation in a normal use environment, and therefore required to be resistant to radiation. At present, an ethylene propylene rubber, polychloroprene rubber, chlorosulfonated polyethylene or the like is used for cable insulation and sheath polymers being used in nuclear power stations or the like, and a general method to make the cable insulation and sheath polymers resistant to radiation is to add therein a process oil or an antioxidant such as an aromatic system.

In recent years, however, the electric wires or cables have been required to be further resistant to radiation so that their lives are prolonged or they are applied to nuclear fusion reactor peripheral materials and the like. In prior art, the amounts of the aromatic process oil and the antioxidant have been increased.

Refer to JP-A-05-125251 and JP-A-10-120792, for example.

SUMMARY OF THE INVENTION

In the prior art, however, there are problems, such as the problem of degradation of properties such as tensile strength, fire retardancy or the like, and the problem of bloom of the antioxidant on surface, resulting from the simple increases of the amounts of the aromatic process oil and antioxidant.

Accordingly, an effective solution to these problems is to use a radiation resistant material for the polymers themselves, as described in JP-A-10-120792.

The inventors have found through study that a polymer having a naphthylene group has unprecedented excellent radiation resistance. Although it is generally known that aromatic rings serve as protection from radiation, it has been found that the polymer having a naphthylene group has unprecedented excellent radiation resistance, in comparison with a polymer having a phenylene group, such as polyether ether ketone (PEEK), polyphenylene oxide (PPO) or the like, having been used so far (see JP-A-05-125251, for example).

However, the aromatic polymer having a naphthylene group is generally poor in flexibility, and therefore difficult to use for electric wire or cable insulations.

Thus, it is an object of the present invention to provide a radiation resistant electric wire and a radiation resistant cable, which overcome the foregoing problem, use an excellent radiation resistant polymer having a naphthylene group, and have flexibility.

(1) According to a first embodiment of the invention, a radiation resistant electric wire comprises:

a conductor;

an inner insulating layer comprising a naphthylene group-containing polymer; and an outer insulating layer comprising a cross-linked polyolefin, wherein the conductor is coated with the inner insulating layer and the outer insulating layer therearound.

In the first embodiment, the following modifications and changes can be made.

The naphthylene group-containing polymer may comprise polyethylene naphthalate (PEN) or polybutylene naphthalate (PBN).

(2) According to a second embodiment of the invention, a radiation resistant cable comprises:

a plurality of electric wires stranded together; and a sheath, with which a perimeter of the stranded electric wires is covered, wherein the electric wires comprise a conductor, an inner insulating layer comprising a naphthylene group-containing polymer, and an outer insulating layer comprising a cross-linked polyolefin, and the conductor is coated with the inner insulating layer and the outer insulating layer therearound.

In the second embodiment, the following modifications and changes can be made.

The naphthylene group-containing polymer may comprise polyethylene naphthalate (PEN) or polybutylene naphthalate (PBN).

Points of the Invention

According to the embodiments of the invention, the naphthylene group-containing polymer is disposed in the inner side. This allows the flexibility of the electric wire or cable while ensuring some thickness of the coating, and restricting the volume of the naphthylene group-containing polymer occupied in the entire insulating layers.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Below is described one preferred embodiment according to the invention in conjunction with the accompanying drawings.

Figure 1:
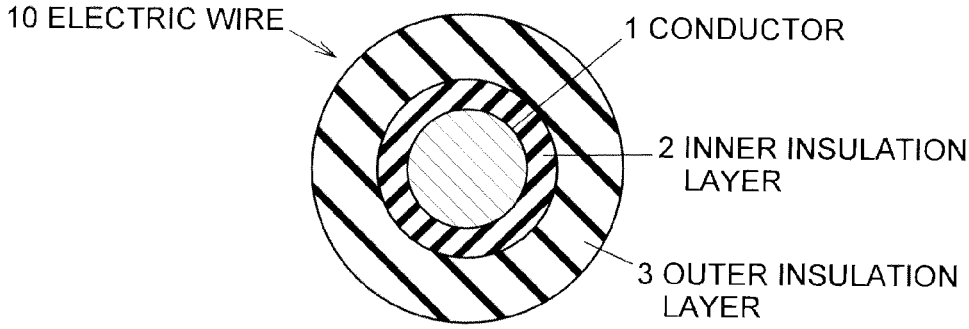
FIG. 1 is a cross sectional view showing an electric wire in one embodiment according to the invention.
Figure 2:
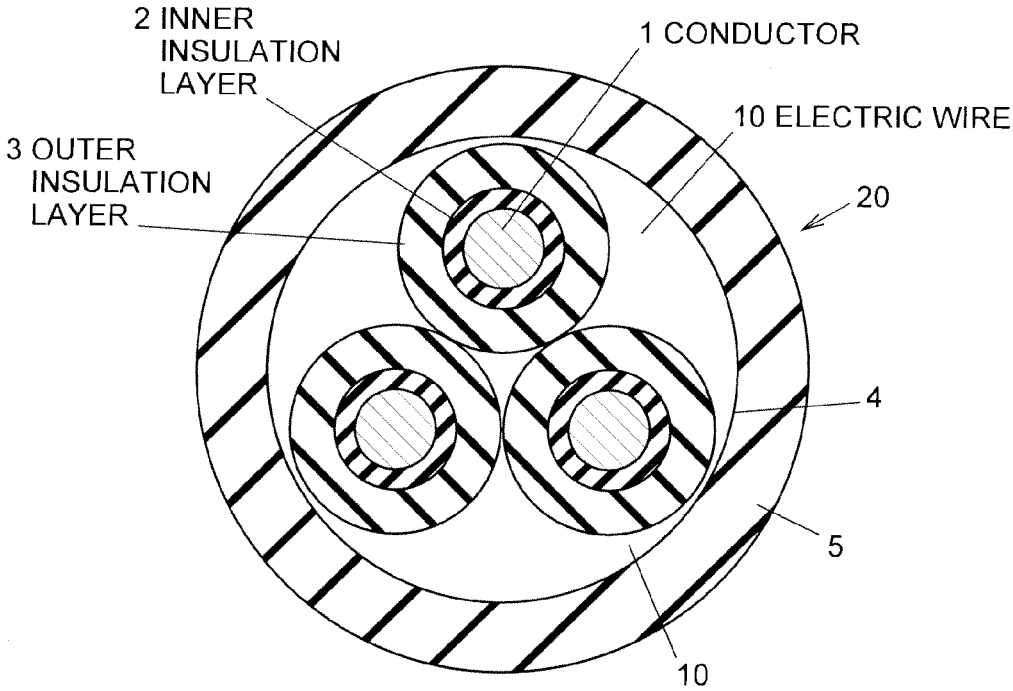
FIG. 2 is a cross sectional view showing a cable using the electric wire of FIG. 1.

An electric wire and a cable according to the invention are first described by use of FIGS. 1 and 2, respectively.

Electric Wire 10 Structure

An electric wire 10 shown in FIG. 1 is that coated with a double layered insulation around a conductor 1. The insulation comprises an inner insulation layer (first insulating layer) 2 comprising a naphthylene group-containing polymer, and an outer insulation layer (second insulating layer) 3 comprising a cross-linked polyolefin.

Cable 20 Structure

A cable 20 shown in FIG. 2 is formed as follows: The electric wires 10 shown in FIG. 1, i.e. the electric wires 10 coated with the double layered insulation around the conductor 1, comprising the inner insulation layer (first insulating layer) 2 comprising a naphthylene group-containing polymer, and the outer insulation layer (second insulating layer) 3 comprising a cross-linked polyolefin, are stranded together, bound with a binding tape 4, and covered with a sheath 5 around its outermost layer. This results in the cable 20 shown in FIG. 2.

Naphthylene Group-Containing Polymer Used for the Inner Insulation Layer 2

The naphthylene group-containing polymer used for the first insulating layer (inner insulation layer) 2 according to the invention is not particularly limited, but is preferably polyethylene naphthalate (PEN), or polybutylene naphthalate (PBN), which may be used alone or by blending them.

Cross-Linked Polyolefin Polymer Used for the Outer Insulation Layer 3

The cross-linked polyolefin polymer used for the second insulating layer (outer insulation layer) 3 is exemplified by halogen polymers, such as polychloroprene, chlorosulfonated polyethylene, and chlorinated polyethylene, and non-halogen polymers, such as polyethylenes such as ultralow density polyethylenes, low density polyethylenes, medium density polyethylenes, and high density polyethylenes, ethylene vinyl acetate (EVA) copolymers, ethylene ethyl acrylate (EEA) copolymers, ethylene methyl acrylate (EMA) copolymers, natural rubbers (NR), ethylene propylene rubbers (EPM), ethylene propylene diene terpolymers (EPDM), butyl rubbers (IIR), and nitrile rubbers (NBR). The cross-linked polyolefin polymer is not limited to one of the halogen polymers or the non-halogen polymers, but these polymers may be used alone or by blending two or more thereof.

Additives

Also, additives, such as a fire retardant, antioxidant, anti-radiation agent, lubricant, softener, plasticizer, inorganic filler, compatibilizing agent, stabilizer, carbon black, coloring agent, cross-linker, and cross-linking aid, may, if desired, be added to both the first insulating layer 2 comprising the naphthylene group-containing polymer, and the second insulating layer 3 comprising the cross-linked polyolefin.

Fire Retardant

The fire retardant is not limited to one of halogen fire retardants or non-halogen fire retardants. The halogen fire retardants are exemplified by chlorine based fire retardants such as chlorinated paraffins or perchloropentadecane, hexabromobenzene, bis(tribromophenoxy)ethane, bis(pentabromophenoxy)ethane, ethylene bis-dibromonorbornane dicarboximide, ethylene bistetrabromophthalimide, dibromoethyldibromocyclohexane, dibromoneopentyl glycol, tribromophenol, tribromophenol allyl ether, tetrabisphenol A derivatives, tetrabisphenol S, tetradecabromodiphenoxy benzene, tris-(2,3-dibromopropyl-1)-isocyanurate, 2,2'-bis(4-hydroxy-3,5-dibromophenyl)propane, 2,2'-bis(4-hydroethoxy-3,5-dibromophenyl)propane, pentabromotoluene, pentabromocyclododecane, dibromoneopentyl glycol tetracarbonate, bis(tribromophenyl)fumaramide, and N-methylhexabromodiphenylamine.

The non-halogen fire retardants may use e.g. a metal hydroxide such as magnesium hydroxide, aluminum hydroxide or the like, a borate compound such as zinc borate, calcium borate, barium borate, barium metaborate or the like, a nitrogen based fire retardant such as guanidine sulfaminate, melamine sulfate, melamine cyanurate or the like, or an intumescent based fire retardant comprising a mixture of a foaming component and a hardening component when burnt. Further, in order to enhance fire retardancy, an inorganic fire retardant such as antimony trioxide or the like may be used together with the halogen fire retardants.

Antioxidant

The antioxidant is of two main types: primary phenol or amine antioxidants and secondary sulfurous or phosphorus antioxidants. These antioxidants may be used alone or two or more thereof may be used together.

The primary phenol antioxidants may use e.g. 2,6'-di-ter-butyl-4-methylphenol, 2,6'-di-ter-butyl-4-ethylphenol, or mono(α-methylbenzyl)phenol, 2,2'-methylenebis(4-methyl-6-ter-butylphenol), 2,2'-methylenebis(4-ethyl-6-ter-butylphenol), 4,4'-butylidenebis(3-methyl-6-ter-butylphenol), 4,4'-tiobis(3-methyl-6-ter-butylphenol), di(α-methylbenzyl) phenol, 2,5'-di-ter-butylhydroquinone, 2,5'-di-ter-amylhydroquinone, tri(α-methylbenzyl)phenol, p-cresol, or dicyclopentadiene, etc.

The primary amine antioxidants may use e.g. 2,2,4-trimethyl-1,2-dihydroquinoline, 6-ethoxy-1,2-dihydro-2,2,4-trimethylquinoline, phenyl-1-naphthylamine, alkylated diphenylamine, octylated diphenylamine, 4,4'-bis(α,α-dimethylbenzyl)diphenylamine, p-(p-toluenesulfonylamide) diphenylamine, N,N'-di-2-naphthyl-p-phenylenediamine, N,N'-diphenyl-p-phenylenediamine, N-phenyl-N'-isopropyl-p-phenylenediamine, N-phenyl-N'-(1,3-dimethylbutyl)-p-phenylenediamine, or N-phenyl-N'-(3-methacryloyloxy-2-hydroxypropyl)-p-phenylenediamine, bis(2,2,6,6-tetramethyl-4-piperidyl)sebacate, 8-benzyl-7,7,9,9-tetramethyl-3-octyl-1,2,3-triazaspiro[4,5]undecane-2,4-dione, tetraxy(2,2,6,6-tetramethyl-4-piperidyl) 1,2,3,4-butane tetracarboxylate, etc.

The secondary sulfurous antioxidants may use e.g. 2-mercaptobenzimidazole, 2-mercaptomethylimidazole, 2-mercaptobenzimidazole zinc salt, nickel diethyldithiocarbamate, nickel dibutyldithiocarbamate, 1,3-bis(dimethylaminopropyl)-2-thiourea, or tributylthiourea, etc.

The secondary phosphorus antioxidants may use e.g. tris (nonylphenyl)phosphite, etc.

The quantity of the antioxidant to be added is not particularly limited, but is desirably on the order of from 0.1 to 15 parts by mass relative to 100 parts by mass of polymer. The added antioxidant quantity being less than 0.1 parts by mass has no antioxidant effect, while the added antioxidant quantity being more than 15 parts by mass tends to degrade its properties, such as tensile strength and the like.

Antiradiation Agent

The antiradiation agent may use e.g. a petroleum derived oil (i.e. a process oil) or an aromatic ring (benzene ring) containing ester plasticizer. The process oil may use e.g. a paraffinic oil, aromatic oil, or naphthenic oil, to be added to rubber materials, or the like. The ester plasticizer may use e.g. a plasticizer having in its molecule an aromatic ring, such as bis(2-ethylhexyl)phthalate (or called dioctyl phthalate (DOP)), diisononyl phthalate (DINP), diisodecyl phthalate (DIDP), or tri-2-ethylhexyl trimellitate (or called trioctyl trimellitate (TOTM)).

Thickness of the First Insulating Layer 2

Also, the thickness of the first insulating layer 2 using the naphthylene group-containing polymer is not particularly specified, but is suitably from 0.1 to 1 mm, more suitably from 0.3 to 0.5 mm, because the first insulating layer 2 thickness being less than 0.1 mm makes uniform coating difficult, while the first insulating layer 2 thickness being more than 1 mm makes the electric wire or cable hard, resulting in poor flexibility.

The radiation resistant effect of the naphthylene group-containing polymer depends on the thickness of the coating of naphthylene group-containing polymer. Although the coating requires some thickness to be resistant to radiation, the naphthylene group-containing polymer is hard, leading to a decrease in the flexibility of the electric wire or cable. Thus, in order to allow the flexibility of the electric wire or cable while ensuring the radiation resistant thickness of the coating, the naphthylene group-containing polymer is disposed in the inner side. This allows the flexibility of the electric wire or cable while ensuring some thickness of the coating, and restricting the volume of the naphthylene group-containing polymer occupied in the entire insulating layers.

EXAMPLES

Examples of the invention and Comparative examples are described.

First, Table 1 shows resin compositions of inner layers 1 to 12 respectively used as the first insulating layer 2 of the electric wire 10 described with FIG. 1 and the electric wires 10 of the cable 20 described with FIG. 2, and Table 2 shows resin compositions of outer layers 1 to 7 respectively used as the second insulating layer 3.

TABLE 1

(Combining quantity: part by mass)

| | | Inner layer 1 | Inner layer 2 | Inner layer 3 | Inner layer 4 | Inner layer 5 | Inner layer 6 | Inner layer 7 | Inner layer 8 | Inner layer 9 | Inner layer 10 | Inner layer 11 | Inner layer 12 |
|---|---|---|---|---|---|---|---|---|---|---|---|---|---|
| Polymers | Polybutylene naphthalate *1 | 100 | | 50 | 50 | | | | | | | | |
| | Polyethylene naphthalate *2 | | 100 | 50 | | | | | | | | | |
| | Polyether ether ketone *3 | | | | 50 | 100 | | | | | | | |
| | Ethylene propylene rubber *4 | | | | | | 100 | 100 | 100 | 100 | 100 | | |
| | Polychloroprene rubber *5 | | | | | | | | | | | 100 | |
| | Chlorosulfonated polyethylene *6 | | | | | | | | | | | | 100 |
| Process oil | Aromatic oil *7 | | | | | | | | 5 | 5 | 90 | 5 | 5 |
| Fire retardants | Antimony trioxide *8 | | | | | | | | | 5 | | | |
| | Brominated fire retardant *9 | | | | | | | | | 20 | | | |
| Antioxidants | Amine antioxidant *10 | | | | | | | 2 | 2 | 2 | 2 | 2 | 2 |
| | Sulfurous antioxidant *11 | | | | | | | 2 | 2 | 2 | 2 | 2 | 2 |
| Cross-linkers | Dicumyl peroxide *12 | | | | | | 3 | 3 | 3 | 3 | 3 | | |
| | Red lead *13 | | | | | | | | | | | 30 | 30 |

*1 Polybutylene naphthalate TQB-OT (TEIJIN CHEMICALS LTD.),
*2 TEONEX TN 8065S (TEIJIN CHEMICALS LTD.),
*3 VESTAKEEP 4000G (DAICEL EVONIK LTD.),
*4 EPT 3045 (MITSUI CHEMICALS, INC.),
*5 Chloroprene (Showa Denko K.K.),
*6 HYPALON ® 40 (DuPont Performance Elastomers),
*7 AROMAX 1 (Nippon Oil Corporation),
*8 Antimony trioxide (Twinkling Star Co., Ltd.),
*9 SAYTEX ® 8010 (Albemarle Corporation),
*10 Vulkanox ® DDA (Bayer AG),
*11 NOCRAC NBC (OUCHI SHINKO CHEMICAL INDUSTRIAL),
*12 PERCUMYL ® D (NOF CORPORATION),
*13 Red lead (Shinagawa Chemical Industry Co., Ltd.)

TABLE 2

(Combining quantity: part by mass)

| | | Outer layer 1 | Outer layer 2 | Outer layer 3 | Outer layer 4 | Outer layer 5 | Outer layer 6 | Outer layer 7 |
|---|---|---|---|---|---|---|---|---|
| Polymers | Ethylene propylene rubber *1 | 100 | 100 | 100 | 100 | 100 | | |
| | Polychloroprene rubber *2 | | | | | | 100 | |
| | Chlorosulfonated polyethylene *3 | | | | | | | 100 |
| Process oils | Aromatic oil *4 | | | 5 | | 5 | 5 | 5 |
| | TDAE *5 | | | | 5 | | | |
| Fire retardants | Antimony trioxide *6 | | | | 5 | | | |
| | Brominated fire retardant *7 | | | | 20 | | | |
| | Magnesium hydroxide *8 | | | | | 20 | | 20 |

TABLE 2-continued

| | | Outer layer 1 | Outer layer 2 | Outer layer 3 | Outer layer 4 | Outer layer 5 | Outer layer 6 | Outer layer 7 |
|---|---|---|---|---|---|---|---|---|
| | | | | | | | (Combining quantity: part by mass) | |
| Antioxidants | Amine antioxidant *9 | | 2 | 2 | 2 | 2 | 2 | 2 |
| | Sulfurous antioxidant *10 | | 2 | 2 | 2 | 2 | 2 | 2 |
| Cross-linkers | Dicumyl peroxide *11 | 3 | 3 | 3 | 3 | 3 | | |
| | Red lead *12 | | | | | | 30 | 30 |

*1 EPT 3045 (MITSUI CHEMICALS, INC.),
*2 Chloroprene (Showa Denko K.K.),
*3 HYPALON ® 40 (DuPont Performance Elastomers),
*4 AROMAX 1 (Nippon Oil Corporation),
*5 Elamic 30 (Nippon Oil Corporation),
*6 Antimony trioxide (Twinkling Star Co., Ltd.),
*7 SAYTEX ® 8010 (Albemarle Corporation),
*8 KISMA ® 5A (Kyowa Chemical Industry Co.,Ltd.)
*9 Vulkanox ® DDA (Bayer AG),
*10 NOCRAC NBC (OUCHI SHINKO CHEMICAL INDUSTRIAL)
*11 PERCUMYL ® D (NOF CORPORATION),
*12 Red lead (Shinagawa Chemical Industry Co., Ltd.)

Next, Table 3 shows Examples 1 to 10 and Comparative examples 1 to 8, in which electric wires (or electric wires for cables) are fabricated by combining the inner layers 1 to 12 shown in Table 1 and the outer layers 1 to 7 shown in Table 2, and their properties are evaluated.

TABLE 3

| | | | Example 1 | 2 | 3 | 4 | 5 | 6 | 7 | 8 | 9 | 10 |
|---|---|---|---|---|---|---|---|---|---|---|---|---|
| Electric wire structure | Inner insulation layer (A) | | Inner layer 1 | Inner layer 1 | Inner layer 1 | Inner layer 1 | Inner layer 1 | Inner layer 1 | Inner layer 1 | Inner layer 2 | Inner layer 3 | Inner layer 4 |
| | Outer insulation layer (B) | | Outer layer 1 | Outer layer 2 | Outer layer 3 | Outer layer 4 | Outer layer 5 | Outer layer 6 | Outer layer 7 | Outer layer 1 | Outer layer 1 | Outer layer 1 |
| | Insulation thickness (mm) (A/B) | | 0.3/0.5 | 0.1/0.7 | 0.5/0.3 | 0.3/0.5 | 0.3/0.5 | 0.3/0.5 | 0.3/0.5 | 0.3/0.5 | 0.3/0.5 | 0.3/0.5 |
| Properties | Tensile property (Initial value) | Tensile strength (MPa) | 25.0 | 13.0 | 42.3 | 26.5 | 26.5 | 25.8 | 26.0 | 19.0 | 20.9 | 25.9 |
| | | Elongation (%) | 300 | 300 | 270 | 290 | 300 | 270 | 260 | 330 | 300 | 240 |
| | Radiation resistance (1 MGy) | Tensile strength (MPa) | 29.5 | 14.5 | 46.5 | 29.0 | 28.6 | 29.2 | 28.0 | 21.6 | 21.3 | 23.4 |
| | | Elongation (%) | 270 | 290 | 270 | 260 | 300 | 270 | 250 | 260 | 280 | 280 |
| | Radiation resistance (2 MGy) | Tensile strength (MPa) | 30.8 | 16.0 | 49.0 | 31.5 | 32.0 | 33.0 | 30.9 | 23.0 | 22.9 | 22.9 |
| | | Elongation (%) | 200 | 230 | 240 | 220 | 210 | 200 | 210 | 180 | 190 | 170 |
| | Appearance | | Good | Good | Good | Good | Good | Good | Good | Good | Good | Good |
| | Evaluation | | Good | Good | Good | Good | Good | Good | Good | Good | Good | Good |

| | | Comparative example 1 | 2 | 3 | 4 | 5 | 6 | 7 | 8 |
|---|---|---|---|---|---|---|---|---|---|
| Electric wire structure | Inner insulation layer (A) | Inner layer 5 | Inner layer 6 | Inner layer 7 | Inner layer 6 | Inner layer 9 | Inner layer 10 | Inner layer 11 | Inner layer 12 |
| | Outer insulation layer (B) | Outer layer 1 | Outer layer 1 | Outer layer 1 | Outer layer 1 | Outer layer 1 | Outer layer 1 | Outer layer 1 | Outer layer 1 |
| | Insulation thickness (mm) (A/B) | 0.3/0.5 | 0.3/0.5 | 0.3/0.5 | 0.3/0.5 | 0.3/0.5 | 0.3/0.5 | 0.3/0.5 | 0.3/0.5 |

TABLE 3-continued

| | | | | | | | | | | |
|---|---|---|---|---|---|---|---|---|---|---|
| Properties | Tensile property (Initial value) | Tensile strength (MPa) | 49.0 | — | — | — | — | — | 14.0 | 15.6 |
| | | Elongation (%) | 200 | >600 | >600 | >600 | >600 | >600 | 460 | 500 |
| | Radiation resistance (1 MGy) | Tensile strength (MPa) | 47.0 | 0 | 5.0 | 12.3 | 13.0 | 9.0 | 0 | 0 |
| | | Elongation (%) | 60 | 0 | 30 | 140 | 110 | 230 | 0 | 0 |
| | Radiation resistance (2 MGy) | Tensile strength (MPa) | 46.9 | 0 | 0 | 0 | 0 | 12.5 | 0 | 0 |
| | | Elongation (%) | 0 | 0 | 0 | 0 | 0 | 150 | 0 | 0 |
| | Appearance | | Good | Good | Good | Good | Good | Poor | Good | Good |
| | Evaluation | | Poor | Poor | Poor | Poor | Poor | Good | Poor | Poor |

The electric wires (or electric wires for cables) in Table 3 are fabricated as follows.

The inner insulation layers (first insulating layers), the inner layers 1 to 4 comprising the naphthylene group-containing polymers respectively shown in Table 1, and the inner layers 5 to 12 comprising the phenylene group-containing polymers respectively shown in Table 1, are extruded, using a uniaxial extruder, around a 1.8 mm diameter conductor at 250 to 380 degrees Celsius as the inner insulation layer 2 of the electric wire 10 shown in FIG. 1.

The outer insulation layers (second insulating layers), the outer layers 1 to 7 are produced as follows: The components of each kind shown in Table 2 excluding the cross-linkers are combined at the combining proportions shown in Table 2, and kneaded with a pressure kneader into first compounds.

Subsequently, in the pressure kneader held at approximately 60 degrees Celsius, a cross-linker is added and mixed into the resultant first compounds. Thereafter, using the uniaxial extruder, the resultant compounds are extruded around the inner insulation layer coated conductor so that its total insulation thickness is 0.8 mm. This is followed by cross-linking of the outer polyolefin insulation layers 1 to 7 in an approximately 180 degree Celsius high pressure steam for 10 minutes.

The electric wire properties are evaluated with below-described methods.

Tension Test

For the electric wires produced, a tension test is performed in conformity with JISC3005: Initial tensile strength and elongation, and postirradiation tensile strength and elongation are measured.

Irradiation

Using 60 Co at the Takasaki Advanced Radiation Research Institute, Japan Atomic Energy Agency, γ-ray irradiation is performed. The dose rate is approximately 4 kGy/h. The irradiation dose is 1 MGy, and 2 MGy.

Appearance Test

The electric wires prototyped are left to stand at room temperature for 30 hours, and their respective surfaces are thereafter observed with a 10× power magnifying glass. If an electric wire has no bloom or bleed in its surface, its appearance is acceptable and denoted by 'Good,' or if an electric wire has bloom or bleed in its surface, its appearance is not acceptable and denoted by 'Poor.'

Evaluation

If an electric wire is not less than 150% in the postirradiation elongation, and is good in the appearance test, it is acceptable.

As shown in Tables 1 to 3, Examples 1 to 10 use the inner layers 1 to 4 using the naphthylene group-containing polymers respectively as the inner insulation layer. Even when any of the outer polyolefin polymer layers 1 to 7 is used as the outer insulation layer, Examples 1 to 10 after 1 MGy irradiation are therefore not less than 150% in the elongation and good in flexibility, and also after 2 MGy irradiation, acceptably significantly exceed that target value of the elongation property.

Especially, Example 2 using the outer layer 3 as the second insulating layer, in which the antioxidants are added to the polyolefin (ethylene propylene rubber), has been improved in the 1 MGy and 2 MGy postirradiation elongation properties, in comparison with Example 1 using the outer layer 1 to which none of the antioxidants are added. Also, Example 3, in which in addition to the antioxidants the aromatic oil is added, has been more improved in the 2 MGy postirradiation elongation property than Example 2.

For this, it is desirable to add the antioxidants and the aromatic oil to the second insulating layer.

Example 4 using the outer layer 4 in which the antioxidants and the fire retardants are added to the second insulating layer, and Example 5 using the outer layer 5 in which the aromatic oil, the fire retardant, and the antioxidants are added to the second insulating layer, are both good in radiation resistance.

Examples 6 and 7 using the outer layers 6 and 7 using the chlorine based polymers respectively as the second insulating layer, are good in radiation resistance.

Also, Example 8 using the inner layer 2 using the polyethylene naphthalate as the naphthylene group-containing polymer for the first insulating layer, as with the inner layer 1 using the polybutylene naphthalate, is good in radiation resistance. For this, the naphthylene group-containing polymers are excellent in radiation resistance.

Example 9 using the inner layer 3 in which the naphthylene group-containing polymers are blended together, is excellent in radiation resistance. Further, Example 10 using the inner layer 4 in which the naphthylene group-containing polymer and the other polymer are blended together, is excellent in radiation resistance. That is, it is found that when the naphthylene group-containing polymer is contained in the inner layer as a primary component, the naphthylene group-containing polymer blended with the other polymer may be used.

In contrast, Comparative examples 1 to 8 using the inner layers 5 to 12 respectively using no naphthylene group-containing polymer for the first insulating layer, are all poor in radiation resistance.

Comparative example 1 using the inner layer 5 using the polyether ether ketone that is the phenylene based polymer for the first insulating layer, is poor in radiation resistance in comparison with Example 1.

Comparative examples 3 to 6 using the inner layers 7 to 10 respectively using the ethylene propylene rubber as the polymer for the first insulating layer, in which the aromatic oil, the fire retardants, and the antioxidants are added appropriately, have been slightly but not sufficiently improved in radiation resistance in comparison with Comparative example 2 using the inner layer 6 formed of the ethylene propylene rubber to which none of the aromatic oil, the fire retardants, and the antioxidants are added. Comparative examples 3 to 6 are poor in radiation resistance in comparison with Examples 1 to 10 using the naphthylene group-containing polymers. Also, in Comparative example 6 using the inner layer 10 with 90 parts by mass of aromatic oil added thereto, its 2 MGy postirradiation elongation property is the satisfactory minimum, and its radiation resistance is satisfied, but its appearance is poor due to the occurrence of bleed.

Comparative examples 7 and 8 using the inner layers 11 and 12 using the chlorine based polymers respectively as the first insulating layer, are poorer still in radiation resistance.

From the foregoing, the electric wire and cable having the first insulating layer comprising the naphthylene group-containing polymer, and the second insulating layer comprising the cross-linked polyolefin, exhibits the excellent radiation resistance, and is suitable for electric wires and cables required to be resistant to radiation.

Although the invention has been described with respect to the above embodiments, the above embodiments are not intended to limit the appended claims. Also, it should be noted that not all the combinations of the features described in the above embodiments are essential to the means for solving the problems of the invention.

What is claimed is:

1. A radiation resistant electric wire, comprising:

a conductor;

an inner insulating layer comprising a naphthylene group-containing polymer and having a thickness between 0.1 and 1 mm; and an outer insulating layer comprising a cross-linked polyolefin, wherein the conductor is coated with the inner insulating layer and the outer insulating layer therearound.

2. The radiation resistant electric wire according to claim 1, wherein the naphthylene group-containing polymer comprises polyethylene naphthalate (PEN) or polybutylene naphthalate (PBN).

3. The radiation resistant electric wire according to claim 2, wherein the cross-linked polyolefin polymer comprises a halogen polymer, a polyethylene, an ethylene vinyl acetate copolymer, an ethylene ethyl acrylate copolymer, an ethylene methyl acrylate copolymer, a natural rubber, an ethylene propylene rubber, an ethylene propylene diene terpolymer, a butyl rubber, or a nitrile rubber.

4. The radiation resistant electric wire according to claim 2, wherein the cross-linked polyolefin polymer comprises a halogen polymer, and wherein the halogen polymer is one of polychloroprene, chlorosulfonated polyethylene, and chlorinated polyethylene.

5. The radiation resistant electric wire according to claim 2, wherein the cross-linked polyolefin polymer comprises a polyethylene, wherein the polyethylene is one of an ultralow density polyethylene, a low density polyethylene, a medium density polyethylene, and a high density polyethylene.

6. The radiation resistant electric wire according to claim 1, wherein the outer insulating layer is the outermost layer of the wire.

7. The radiation resistant electric wire according to claim 1, wherein the inner insulating layer and the outer insulating layer form a double layered insulation structure.

8. The radiation resistant electric wire according to claim 1, wherein the outer insulating layer consists essentially of the cross-linked polyolefin.

9. A radiation resistant cable, comprising:

a plurality of electric wires stranded together; and a sheath, with which a perimeter of the stranded electric wires is covered, wherein the electric wires comprise a conductor, an inner insulating layer comprising a naphthylene group-containing polymer and having a thickness between 0.1 and 1 mm, and an outer insulating layer comprising a cross-linked polyolefin, and wherein the conductor is coated with the inner insulating layer and the outer insulating layer therearound.

10. The radiation resistant cable according to claim 9, wherein the naphthylene group-containing polymer comprises polyethylene naphthalate (PEN) or polybutylene naphthal ate (PBN).

11. The radiation resistant cable according to claim 10, wherein the cross-linked polyolefin polymer comprises a halogen polymer, a polyethylene, an ethylene vinyl acetate copolymer, an ethylene ethyl acrylate copolymer, an ethylene methyl acrylate copolymer, a natural rubber, an ethylene propylene rubber, an ethylene propylene diene terpolymer, a butyl rubber, or a nitrile rubber.

12. The radiation resistant cable according to claim 10, wherein the cross-linked polyolefin polymer comprises a halogen polymer, and wherein the halogen polymer is one of polychloroprene, chlorosulfonated polyethylene, and chlorinated polyethylene.

13. The radiation resistant cable according to claim 10, wherein the cross-linked polyolefin polymer comprises a polyethylene, wherein the polyethylene is one of an ultralow density polyethylene, a low density polyethylene, a medium density polyethylene, and a high density polyethylene.

14. The radiation resistant cable according to claim 9, wherein the outer insulating layer is the outermost layer of the wires.

15. The radiation resistant cable according to claim 9, wherein the inner insulating layer and the outer insulating layer form a double layered insulation structure.

16. The radiation resistant cable according to claim 9, wherein the outer insulating layer consists essentially of the cross-linked polyolefin.

* * * * *